US010507654B2

(12) United States Patent
Kasai et al.

(10) Patent No.: US 10,507,654 B2
(45) Date of Patent: Dec. 17, 2019

(54) PRINT ELEMENT SUBSTRATE AND LIQUID EJECTION HEAD

(71) Applicant: CANON KABUSHIKI KAISHA, Tokyo (JP)

(72) Inventors: Shintaro Kasai, Yokohama (JP); Yoshiyuki Nakagawa, Kawasaki (JP); Akiko Saito, Tokyo (JP); Takatsugu Moriya, Tokyo (JP); Koichi Ishida, Tokyo (JP); Tatsuya Yamada, Kawasaki (JP); Shuzo Iwanaga, Kawasaki (JP); Tomohiro Sato, Tokyo (JP); Tomoki Ishiwata, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/602,812

(22) Filed: May 23, 2017

(65) Prior Publication Data

US 2017/0341393 A1 Nov. 30, 2017

(30) Foreign Application Priority Data

May 30, 2016 (JP) ..... 2016-107678

(51) Int. Cl.
*B41J 2/14* (2006.01)

(52) U.S. Cl.
CPC ..... *B41J 2/14145* (2013.01); *B41J 2/1404* (2013.01); *B41J 2/14056* (2013.01); *B41J 2/14088* (2013.01); *B41J 2002/14467* (2013.01); *B41J 2202/19* (2013.01); *B41J 2202/20* (2013.01)

(58) Field of Classification Search
CPC .. B41J 2/14145; B41J 2/1404; B41J 2/14056; B41J 2002/14467
See application file for complete search history.

(56) References Cited

U.S. PATENT DOCUMENTS

| | | | |
|---|---|---|---|
| 6,585,352 | B1 | 7/2003 | Torgerson et al. |
| 6,854,820 | B2 | 2/2005 | Murakami et al. |
| 6,866,364 | B2 | 3/2005 | Torgerson et al. |
| 7,524,020 | B2 | 4/2009 | Eguchi et al. |
| 8,308,275 | B2 | 11/2012 | Xie et al. |
| 2002/0039127 | A1 | 4/2002 | Shin et al. |
| 2002/0196301 | A1 | 12/2002 | Murakami et al. |
| 2003/0016270 | A1 | 1/2003 | Kubota et al. |

(Continued)

FOREIGN PATENT DOCUMENTS

| | | | |
|---|---|---|---|
| CN | 1517215 | A | 8/2004 |
| JP | 2004-505818 | A | 2/2004 |
| JP | 2006-264200 | A | 10/2006 |

OTHER PUBLICATIONS

Office Action dated Feb. 1, 2019, in counterpart application CN201710390377.6 (9 pages).

*Primary Examiner* — Geoffrey S Mruk
(74) *Attorney, Agent, or Firm* — Venable LLP

(57) ABSTRACT

A print element substrate and a liquid ejection head capable of suppressing degradation of a print quality caused by a white stripe/black stripe etc., is actualized without using a high degree of microfabrication technology. As a result of asymmetric deformation by swelling in a direction of relative movement to a print medium, print elements having different liquid droplet ejection directions are made to coexist and arrayed for that purpose.

20 Claims, 13 Drawing Sheets

(56) References Cited

U.S. PATENT DOCUMENTS

| | | | | |
|---|---|---|---|---|
| 2003/0184614 | A1 | 10/2003 | Torgerson et al. | |
| 2004/0218007 | A1* | 11/2004 | Tomizawa ..... | B41J 2/1404<br>347/40 |
| 2006/0214975 | A1 | 9/2006 | Eguchi et al. | |

* cited by examiner

PRINT ELEMENT SUBSTRATE AND LIQUID EJECTION HEAD

BACKGROUND OF THE INVENTION

Field of the Invention

The present invention relates to a print element substrate and a liquid ejection head that perform print by ejecting a liquid from a plurality of ejection ports.

Description of the Related Art

When high speed drive is performed with print elements arranged in high density by use of a liquid ejection head, cross talk may be generated, in which ejection from a print element may influence an adjacent or near print element, and speed or direction of ejected liquid droplets may change or unintended mist maybe generated to deteriorate print quality. Accordingly, U.S. Pat. No. 8,308,275 discloses a configuration in which each of print elements is surrounded with a channel-forming member so that adjacent print elements are separated from each other. In such configuration in which print elements are completely separated, the influence of cross talk may be made small. However, such configuration requires a high degree of microfabrication.

Further, U.S. Pat. No. 8,308,275 also discloses a configuration in which three print elements are surrounded collectively with a channel-forming member. Between adjacent print elements surrounded with the channel-forming member, a short channel wall for preventing cross talk is provided, but a channel wall is not provided for an ink inflow port or discharge port. Such configuration may be actualized without requiring a high degree of microfabrication.

Members forming an ejection port and channel in a liquid ejection head may be swelled due to contact with a liquid for long time and may be deformed. When the member is deformed, the amount of an ejected liquid may change, or ejection direction may change to degrade print quality.

In the configuration described in U.S. Pat. No. 8,308,275, in which three print elements are collectively surrounded with a channel-forming member, there is an ejection port having an asymmetric configuration such that a channel wall is long and the other channel wall is short centering on the ejection port. When a channel-forming member is swelled in the configuration, resulting deformation also becomes asymmetric and the ejection port is deformed asymmetrically to change the ejection direction of liquid droplets. Further, since an ejection port deformed asymmetrically due to the swelling and an ejection port deformed symmetrically are disposed alternately, and one with a changed ejection direction of liquid droplets and one with a not changed ejection direction are disposed alternately, a white stripe or a black stripe may be generated when print is performed, to degrade print quality.

SUMMARY OF THE INVENTION

Accordingly, the present invention actualizes a print element substrate and a liquid ejection head that may suppress degradation of print quality caused by a white stripe/black stripe etc., without using a high degree of microfabrication technology.

Consequently, the liquid ejection head of the present invention is a liquid ejection head including arrayed substrates equipped with a plurality of ejection ports provided for a plate member, an energy-generating element that is provided facing the ejection port and generates energy for use in ejecting a liquid from the ejection port, a first wall that is connected with the plate member and forms a part of a channel through which a liquid flows provided on a side of the energy-generating element, and a second wall having a volume larger than that of the first wall provided on the other side of the energy-generating element, wherein: a plurality of energy-generating element rows, in which the energy-generating element that is provided with the first wall in a first direction and the second wall provided in a second direction being an opposite direction to the first direction and the energy-generating element in which the second wall is provided in the first direction and the first wall is provided in the second direction are arrayed, are equipped in parallel each other at a predetermined period; and the plurality of the energy-generating element rows are provided, shifted in the energy-generating element row in a direction in which the energy-generating elements are arrayed in a deviation by a space or less between the adjacent energy-generating elements in the energy-generating element row.

According to the present invention, a print element substrate and a liquid ejection head capable of suppressing degradation of print quality caused by a white stripe/black stripe etc. may be actualized without using a high degree of microfabrication technology.

Further features of the present invention will become apparent from the following description of exemplary embodiments with reference to the attached drawings.

DESCRIPTION OF THE EMBODIMENTS (First Embodiment)

Hereinafter, a first embodiment of the present invention will be described with reference to the drawings.

Figure 1A:
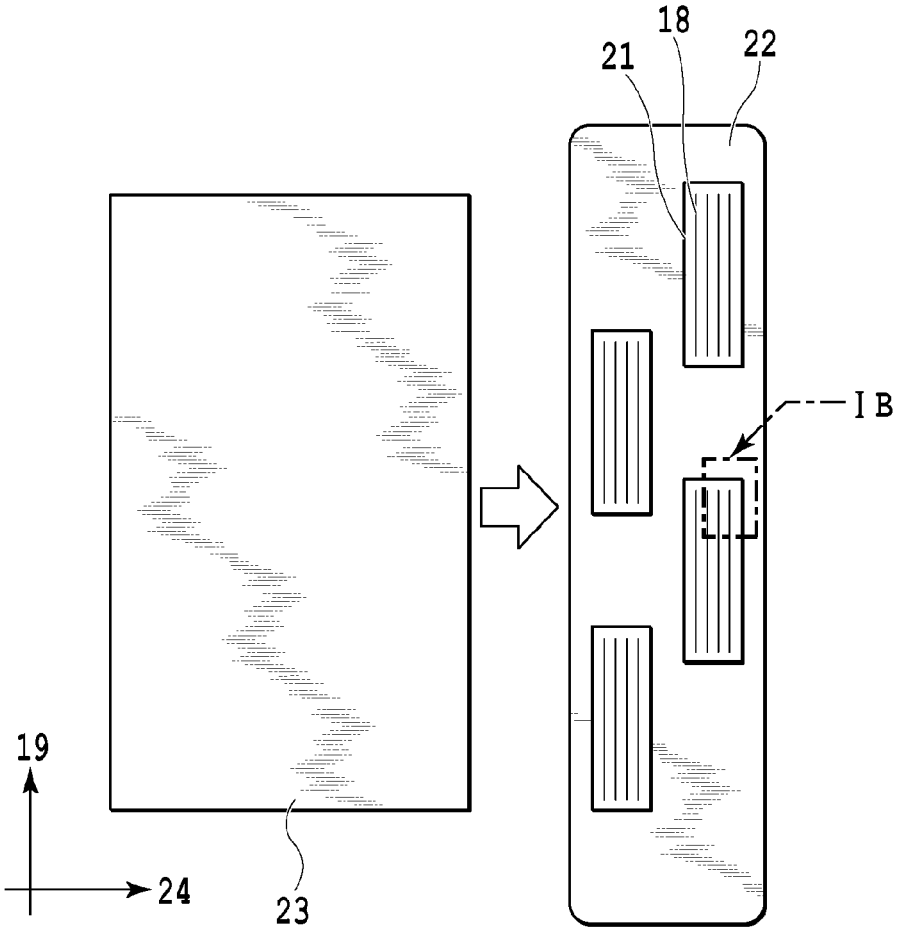
FIG. 1A is a drawing showing positional relationship between the arrangement of print element substrates and a print medium.
Figure 1B:
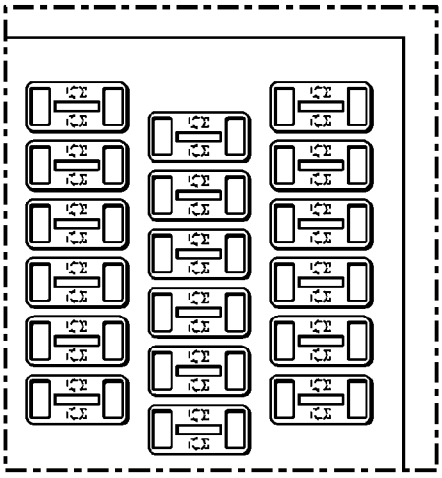
FIG. 1B is a drawing showing positional relationship between the arrangement of print element substrates and a print medium.

FIGS. 1A and 1B are drawings showing positional relationship between the arrangement of print element substrates and a print medium 23 in a liquid ejection head 22 of the embodiment. The liquid ejection head 22 is equipped with four print element substrates 21 for which a plurality of print element rows 18 are arranged. By arranging the print element substrates 21 so as to be overlapped with each other, the print element rows 18 are arranged without a gap in the direction intersecting with print element rows in different print element substrates 21.

Print is performed by moving the print medium 23 such as paper in a direction of relative movement between the liquid ejection head 22 and the print medium (an arrow 24 direction). In a frame shown with a dotted line in FIGS. 1A and 1B, a drawing of a partially enlarged print element substrate 21 is shown.

Hereinafter, details of the print element substrate 21 will be described.

Figure 2A:
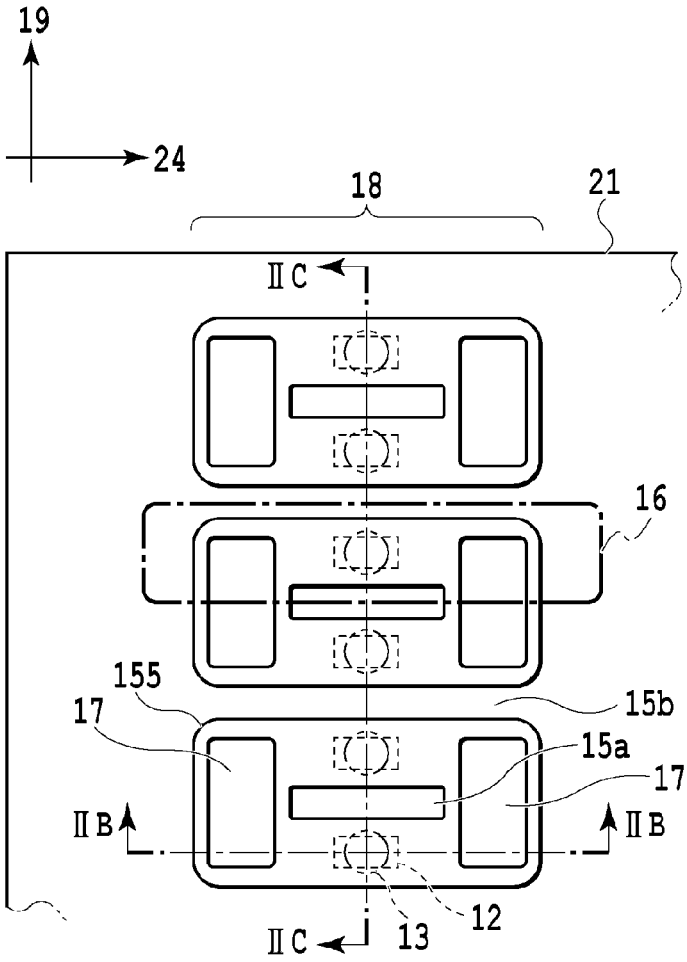
FIG. 2A is a drawing showing a print element row in a print element substrate.
Figure 2C:
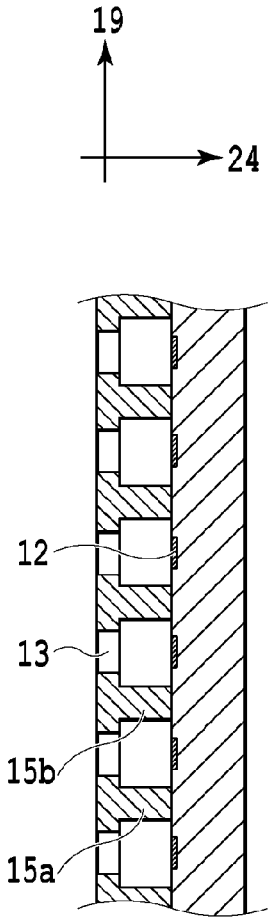
FIG. 2C is a cross-sectional view showing a cross-section of a channel in a position of a print element.
Figure 2B:
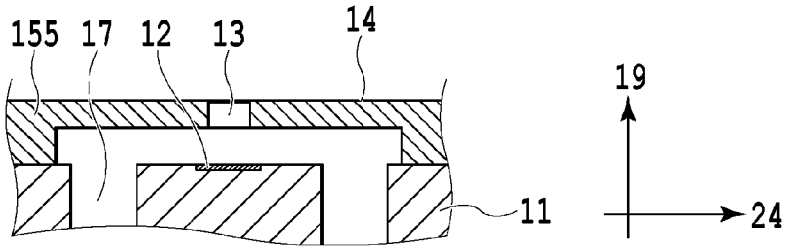
FIG. 2B is a cross-sectional view showing a cross-section of a channel in a position of a print element.

FIG. 2A is a drawing showing a print element row in the print element substrate 21 of the embodiment, FIG. 2B is a cross-sectional view along IIB-IIB in FIG. 2A, which is a cross-sectional view showing a cross-section of a channel in a position of a print element of the print element substrate 21. FIG. 2C is a cross-sectional view along IIC-IIC in FIG. 2A, which is a cross-sectional view showing a cross-section of a channel in a position of a print element of the print element substrate 21. A heater 12 that is an energy-generating element arranged on a substrate 11 is provided, and an orifice plate (plate member) 14 is provided in a position facing (opposite to) the substrate 11. For the orifice plate 14, an ejection port 13 is provided in a position facing the heater 12, and, in addition, a supply port 17 is provided on the substrate 11, to supply a liquid to a position of the heater 12 from the supply port 17. Between the heaters 12, channel walls 15*a* (a first wall), 15*b* (a second wall) are disposed. The channel walls 15*a* and 15*b* are connected with the orifice plate 14. Meanwhile, the channel walls 15*a* and 15*b*, and the orifice plate 14 may be formed integrally with the same material.

A print element 16 is formed from the heater 12, the ejection port 13, the orifice plate 14, the liquid supply port 17, and the channel walls 15*a* and 15*b*. By an impulsive force of bubbles generated by heating a liquid with the heater 12, the liquid is ejected from the ejection port 13, which impacts a print medium to perform print. The ejection port 13 is arranged in a line to form an ejection port row. The print element 16 is arranged in a row to form a print element row (energy-generating element row) 18. The channel wall 15 includes a short channel wall 15*a* and a long channel wall 15*b*. The long channel wall 15*b* extends between the supply ports 17, and, is further connected up to a liquid chamber wall 155. The print elements 16 lying on both sides of the long channel wall 15*b* are separated from each other in point of a fluid (but communicated on the backside of the substrate through the liquid supply port 17). The short channel wall 15*a* and the long channel wall 15*b* are arranged alternately, and the print element 16 is asymmetric in the print element row direction centering on the ejection port 13. The print elements 16 adjacent to each other in a print element row are mirror symmetric relative to an axis in the direction perpendicular (approximately perpendicular) to the print element row 18 (an arrow 24 direction).

Since the long channel wall 15*b* is connected up to the wall 155, the ejection port 13 is arranged in pairs for an independent liquid chamber. Consequently, between print elements isolated by the long channel wall 15*b*, the influence of cross talk may be suppressed. Further, between print elements isolated by the short channel wall 15*a*, the influence of cross talk may be suppressed by setting a long driving period of time.

Figure 3A:
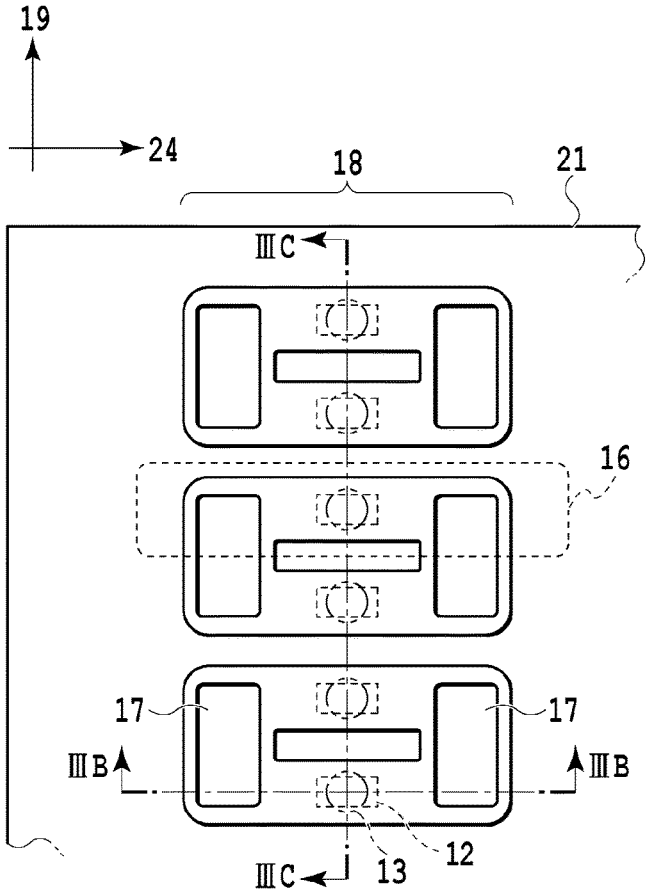
FIG. 3A is a drawing showing a print element row in a print element substrate and a cross-section of a print element.
Figure 3C:
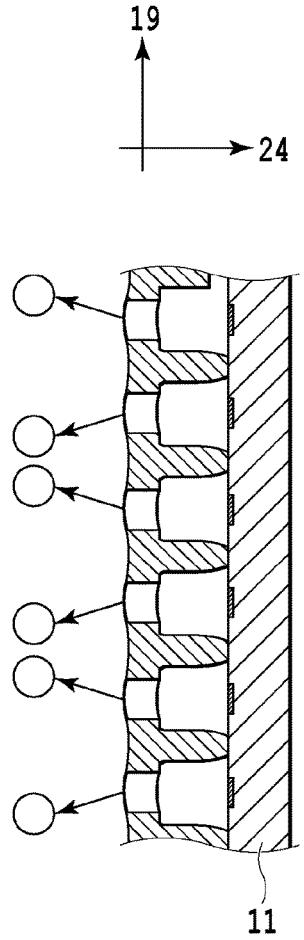
FIG. 3C is a cross-sectional view showing a cross-section of a swelled channel in a print element substrate.
Figure 3B:
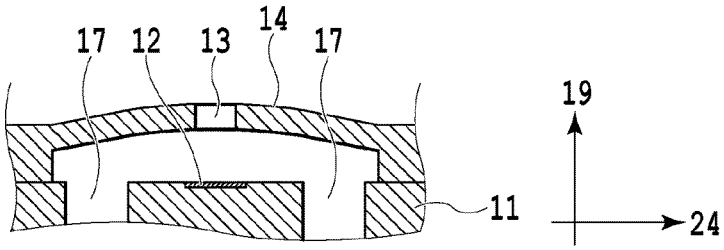
FIG. 3B is a cross-sectional view showing a cross-section of a swelled channel in a print element substrate.

FIG. 3A is a drawing showing a print element row in the print element substrate 21 of the embodiment, FIG. 3B is a cross-sectional view along IIIB-IIIB in FIG. 3A, which is a cross-sectional view showing a cross-section of a swelled channel in a position of a print element of the print element substrate 21. FIG. 3C is a cross-sectional view along IIIC-IIIC in FIG. 3A, which is a cross-sectional view showing a cross-section of a swelled channel in a position of a print element of the print element substrate 21. When a channel wall and orifice plate are formed from a resin member, it is swelled and deformed by being immersed in a liquid for long time. Since the long channel wall 15*b* has a larger volume than the short channel wall 15*a*, swelling thereof leads to such a shape that the ejection port 13 is lifted up, and the ejection port 13 inclines to the shorter channel 15*a* side. Consequently, ejecting liquid droplets are ejected obliquely toward the short channel 15*a*.

Figure 4:
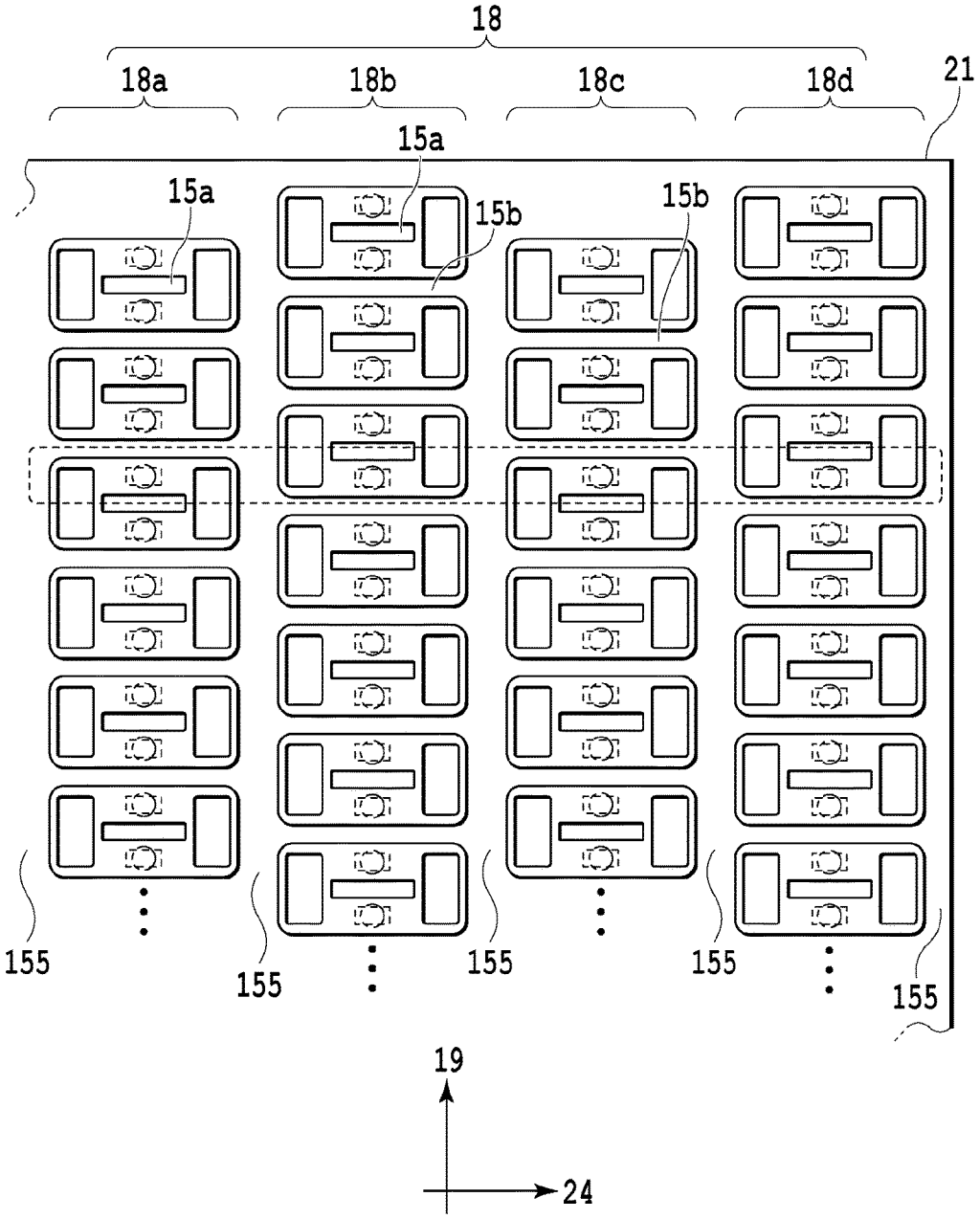
FIG. 4 is a drawing showing an arrangement of print element rows in a print element substrate.

FIG. 4 is a drawing showing an arrangement of the print element rows 18 in the print element substrate 21. Here, an example in which the print element substrate 21 is configured from four rows of the print element rows 18*a*-18*d*, will be described. In the embodiment, a direction in which the liquid ejection head 22 moves relatively to the print medium 23 (the arrow 24 direction) is in a relationship perpendicular to a direction in which the print element row 18 extends.

The plurality of print element rows 18 lying in parallel are shifted each other in an arrow 19 direction (shifted in the array direction of a print element), and the deviation by one print element (they are provided, shifted by the space between print elements). Meanwhile, the liquid chamber wall 155 separates between adjacent print element rows, or between the print element row 18 and the rim of the print element substrate 21. In the arrow 24 direction, respective print elements in a frame of black dotted lines in the drawing are asymmetric in the arrow 19 direction when a channel wall is swelled, and a print element with the long channel wall 15*b* on the upper side and a print element with that on the lower side are arranged alternately. Meanwhile, it is sufficient that the arrangement of print elements is configured from two types of a print element with the long channel wall 15*b* on the upper side and a print element with that on the lower side, not necessarily alternately. In the embodiment, the short channel wall 15*a* and the long channel wall 15*b* are disposed alternately. Further, the print element rows 18*a*-18*d* may also be expressed that phases of rows of long and short channel walls arranged periodically are shifted. In the embodiment, there is phase shift (phase deviation) by one print element between adjacent print element rows.

Figure 5A:
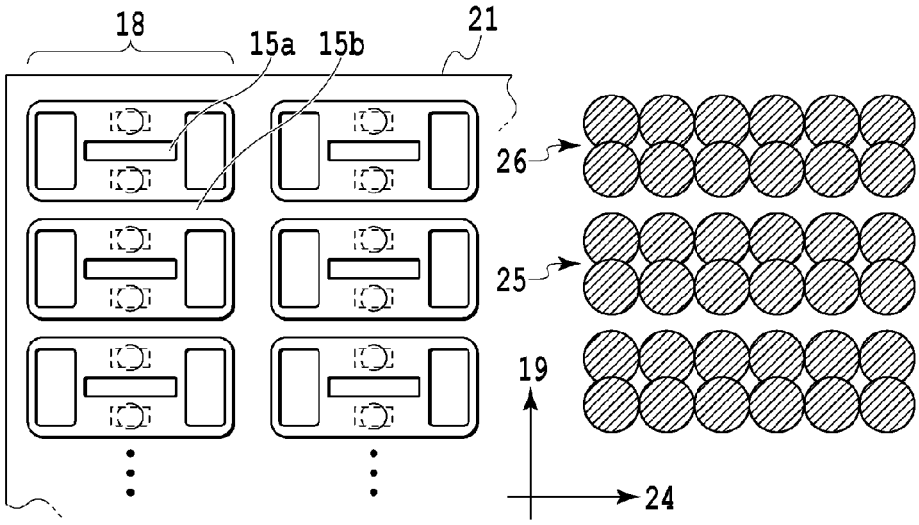
FIG. 5A is a drawing showing the arrangement of print elements and a schematic view of impacted liquid droplets in association with each other.
Figure 5B:
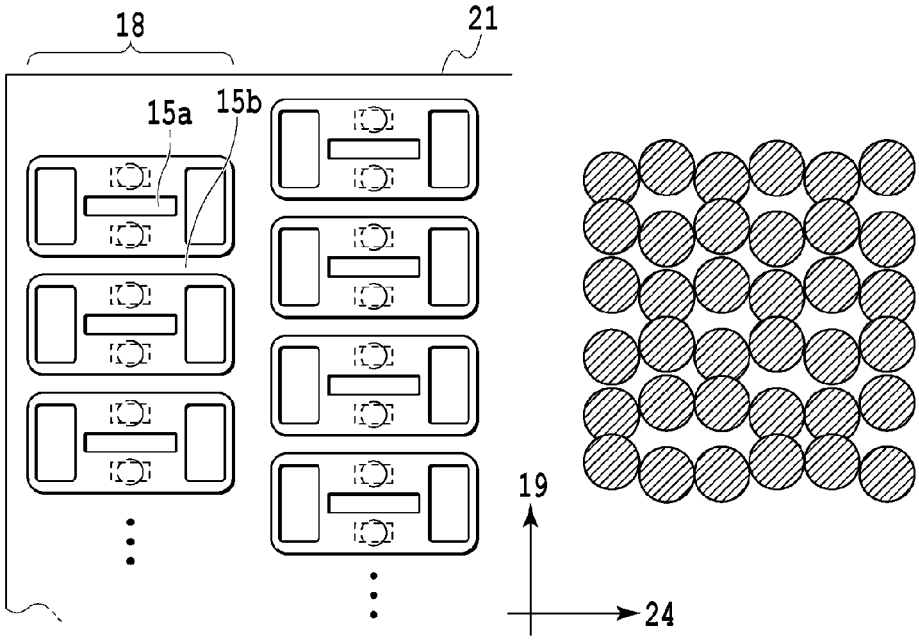
FIG. 5B is a drawing showing the arrangement of print elements and a schematic view of impacted liquid droplets in association with each other.

FIGS. 5A and 5B are drawings showing the arrangement of print elements and a schematic view of impacted liquid droplets in association with each other. FIG. 5A shows a case where the print element rows 18 are arranged without the shift as Comparative Example, and FIG. 5B shows a case where the print element rows 18 in the print element substrate 21 of the embodiment are arranged, shifting each other in a deviation by a space or less between adjacent print elements in the print element rows 18.

In FIG. 5A, by an ejection port asymmetrically deformed by swelling, an ejection direction of liquid droplet changes. In the arrow 24 direction, only liquid droplets ejected, deflected in a direction, impact, and, therefore, a white stripe 25 or a black stripe 26 is generated. In FIG. 5B, in the arrow 24 direction, liquid droplets ejected, deflected in a direction and liquid droplets ejected in the opposite direction, coexist to form an image, and consequently, a white stripe and a black stripe are inconspicuous. Meanwhile, in the embodiment, as a result that respective print element rows 18 print randomly in the arrow 24 direction, generation of a white stripe in an oblique direction is prevented.

In this way, as a result of asymmetric deformation by swelling in a direction of movement relative to a print medium, print elements having different ejection directions of liquid droplets are made to coexist and arrayed. Hereby, a liquid ejection head capable of suppressing degradation of print quality due to a white stripe/black stripe etc. could be actualized without using a high degree of microfabrication technology.

(Second Embodiment)

Hereinafter, a second embodiment of the present invention will be described with reference to the drawings. Meanwhile, the basic configuration of the embodiment is similar to that of the first embodiment, and, therefore, only characteristic configurations will be described below.

Figure 6:
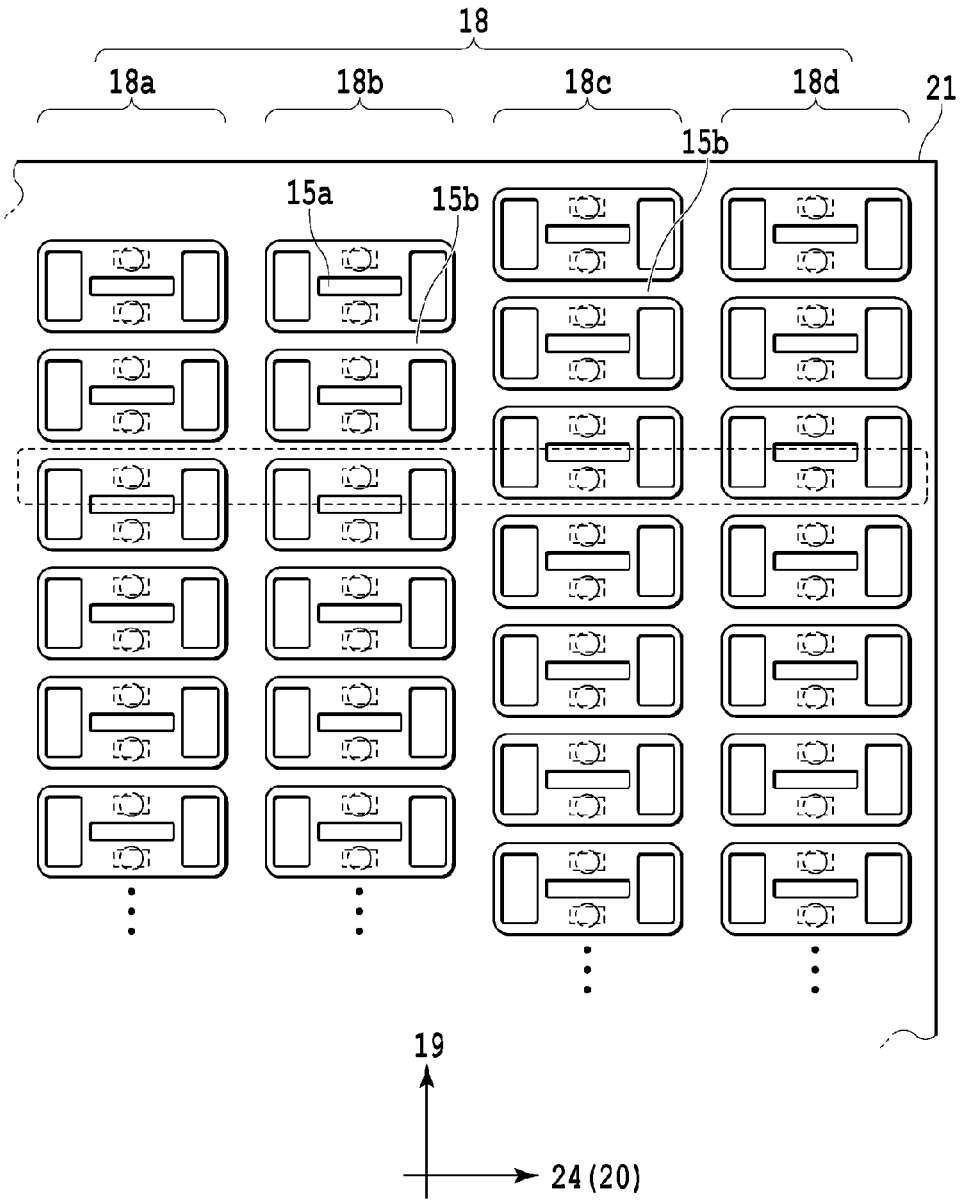
FIG. 6 is a drawing showing print element rows in a print element substrate.

FIG. 6 is a drawing showing print element rows in the print element substrate 21 of the embodiment. In the print element substrate 21 of the embodiment, a configuration, in which four rows of print element rows of the print element rows 18*a*-18*d* are equipped (print element rows are provided in four rows), will be described.

The print element rows 18*a* and 18*b*, and the print element rows 18*c* and 18*d* are not shifted each other in the arrow 19 direction, and the print element rows 18*b* and 18*c* are shifted in the arrow 19 direction, in which the deviation by one print element. In this way, a pair of adjacent print element rows in four print element rows are arranged, shifted each other.

In the embodiment, the short channel wall 15*a* and the long channel wall 15*b* are disposed alternately. It is also possible to express that, in the print element rows 18*b* and 18*c*, the phases of rows of long and short channel walls arranged periodically are shifted. In the embodiment, there is phase shift by one print element between adjacent print element rows.

In the array of the print element rows, as shown by a frame of black dotted lines in the drawing, directions deflected caused by ejection ports that are asymmetrically deformed due to swelling also coexist, and, therefore, liquid droplets ejected, deflected in a direction and liquid droplet ejected, deflected in the opposite direction coexist to form an image. Consequently, in a printed print medium, a white stripe or a black stripe becomes inconspicuous.

In this way, as a result of asymmetric deformation by swelling in a direction of relative movement to a print medium, print elements having different ejection directions of liquid droplets are made to coexist and arrayed. Hereby, a liquid ejection head capable of suppressing degradation of print quality due to a white stripe/black stripe etc. could be actualized without using a high degree of microfabrication technology.

(Third Embodiment)

Hereinafter, a third embodiment of the present invention will be described with reference to the drawings. Meanwhile, the basic configuration of the embodiment is similar to that of the first embodiment, and, therefore, only characteristic configurations will be described below.

Figure 7:
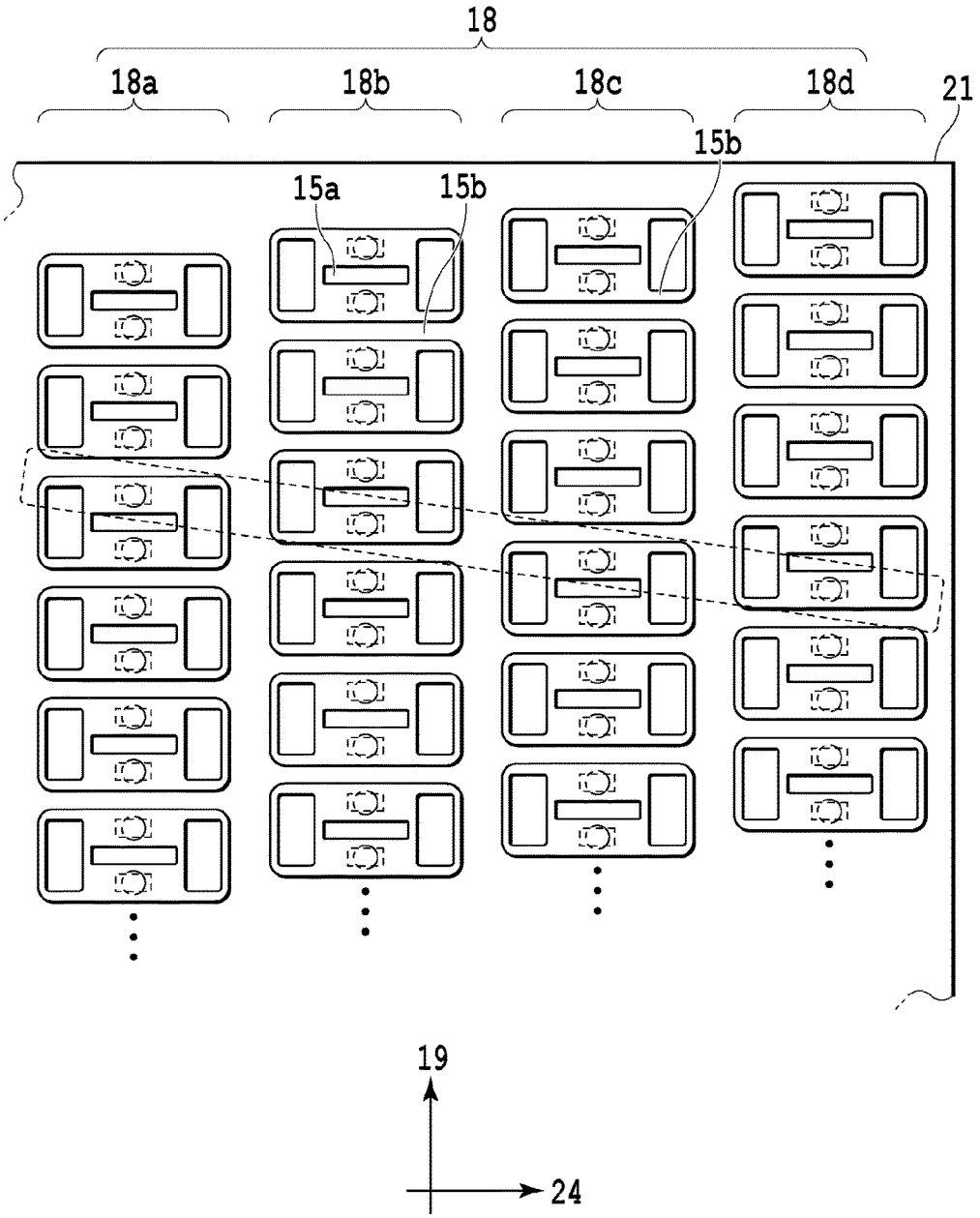
FIG. 7 is a drawing showing print element rows in a print element substrate.

FIG. 7 is a drawing showing print element rows in the print element substrate 21 of the embodiment. In the print element substrate 21 of the embodiment, a configuration equipped with four rows of print element rows of the print element rows 18*a*-18*d*, will be described.

In the embodiment, the direction of relative movement between a liquid ejection head and a print medium is a direction different from the direction intersecting perpendicularly with print element rows (the arrow 24 direction), and they move relatively in an obliquely inclined direction as shown by a frame of black dotted lines in the drawing. The print element rows 18*a*-18*d* are shifted each other.

The short channel wall 15*a* and the long channel wall 15*b* are disposed alternately, and the period thereof by two print elements. The print element rows 18*a*-18*d* may also be expressed that phases of rows of long and short channel walls arranged periodically are shifted. In the embodiment, in the direction of relative movement between a liquid ejection head and a print medium, there is phase shift by one print element between adjacent print element rows.

In such an array of the print element rows, as shown by a frame of black dotted lines in the drawing, directions deflected by ejection ports that are asymmetrically deformed due to swelling also coexist, and, therefore, liquid droplets ejected, deflected in a direction and liquid droplet ejected, deflected in the opposite direction coexist to form an image. Consequently, in a printed print medium, a white stripe or a black stripe becomes inconspicuous.

In this way, as a result of asymmetric deformation by swelling in a direction of relative movement to a print medium, print elements having different ejection directions of liquid droplets are made to coexist and arrayed. Hereby, a liquid ejection head capable of suppressing degradation of print quality due to a white stripe/black stripe etc. could be actualized without using a high degree of microfabrication technology.

(Fourth Embodiment)

Hereinafter, a fourth embodiment of the present invention will be described with reference to the drawings. Meanwhile, the basic configuration of the embodiment is similar to that of the first embodiment, and, therefore, only characteristic configurations will be described below.

Figure 8:
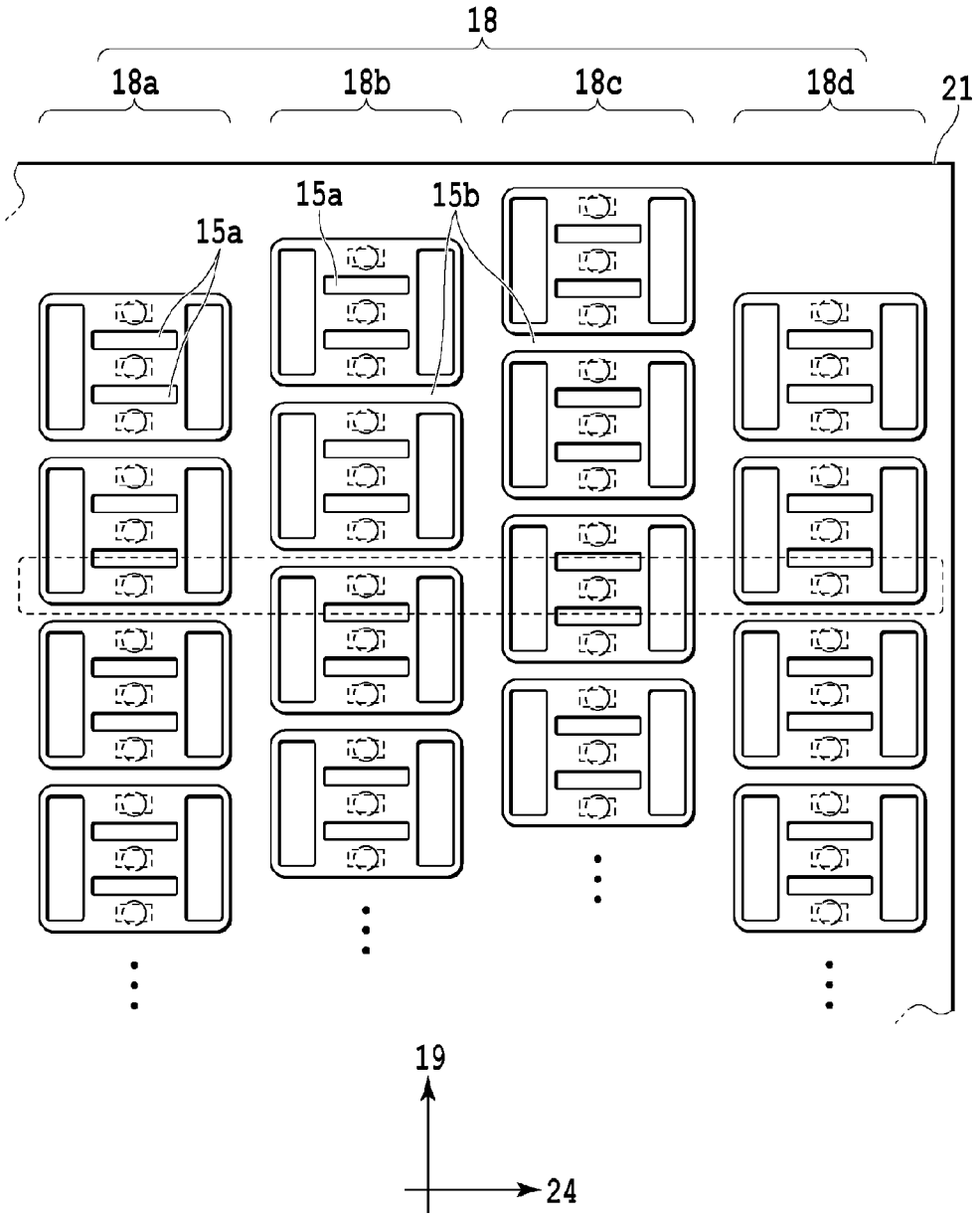
FIG. 8 is a drawing showing print element rows in a print element substrate.

FIG. 8 is a drawing showing print element rows in the print element substrate 21 of the embodiment. The print element substrate 21 of the embodiment has a configuration, in which print element rows of four rows of the print element rows 18*a*-18*d* are equipped and three print elements are collectively surrounded by a channel-forming member. That is, the long channel wall 15*b* is arranged for every three print elements. Meanwhile, the number is not limited to three, but the long channel wall 15*b* may be arranged for every predetermined number of print elements (two or more short channel walls may be provided between long channel walls). Accordingly, an ejection direction of liquid droplets from a print element that is adjacent to a long channel wall and has asymmetric ejection ports, are deflected, but an ejection direction of liquid droplets from a print element surrounded only by short channel walls is not deflected. In the embodiment, the short channel wall 15*a* and the long channel wall 15*b* are disposed periodically. Further, the print element rows 18*a*-18*d* may also be expressed that phases of rows of long and short channel walls arranged periodically are shifted. In the embodiment, there is phase shift by one print element between adjacent print element rows.

In such an array of the print element rows, as shown by a frame of black dotted lines in the drawing, directions deflected by ejection ports that are asymmetrically deformed due to swelling also coexist, and, therefore, liquid droplets ejected, deflected in a direction and liquid droplet ejected, deflected in the opposite direction coexist to form an image. Consequently, in a printed print medium, a white stripe or a black stripe becomes inconspicuous.

In this way, as a result of asymmetric deformation by swelling in a direction of relative movement to a print medium, print elements having different ejection directions of liquid droplets are made to coexist and arrayed. Hereby, a liquid ejection head capable of suppressing degradation of print quality due to a white stripe/black stripe etc. could be actualized without using a high degree of microfabrication technology.

(Fifth Embodiment)

Hereinafter, a fifth embodiment of the present invention will be described with reference to the drawings. Meanwhile, the basic configuration of the embodiment is similar to that of the first embodiment, and, therefore, only characteristic configurations will be described below.

Figure 9:
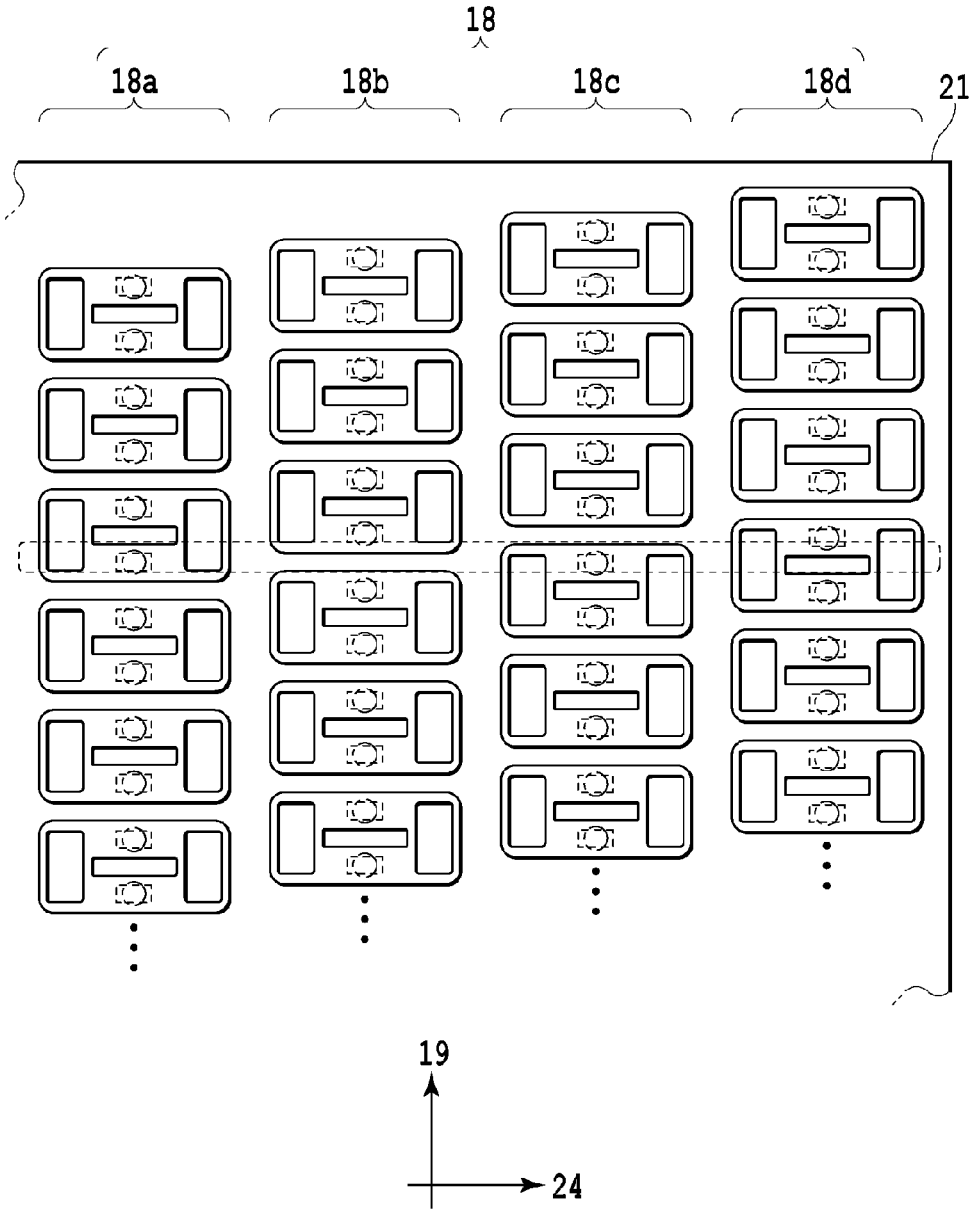
FIG. 9 is a drawing showing print element rows in a print element substrate.

FIG. 9 is a drawing showing print element rows in the print element substrate 21 of the embodiment. The print element substrate 21 of the embodiment is equipped with four rows of print element rows of the print element rows 18*a*-18*d*, in which the print element rows 18*a*-18*b* is shifted by a half of a print element. This corresponds to arraying print elements with twofold density in a print element row direction (the arrow 19 direction) by two rows of print elements 18*a* and 18*b*. In a similar way, by means of two rows of print element rows 18*c* and 18*d*, print element rows with twofold density are formed. In the embodiment, the short channel wall 15*a* and the long channel wall 15*b* are disposed alternately. Further, the print element rows 18*a*-18*d* may also be expressed that phases of rows of long and short channel walls arranged periodically are shifted. In the embodiment, there is phase shift by a half of a print element between adjacent print element rows.

In the array of the print element rows, as shown by a frame of black dotted lines in the drawing, directions deflected by ejection ports that are asymmetrically deformed due to swelling also coexist, and, therefore, liquid droplets ejected, deflected in a direction and liquid droplet ejected, deflected in the opposite direction coexist to form an image. Consequently, in a printed print medium, a white stripe or a black stripe becomes inconspicuous.

In this way, as a result of asymmetric deformation by swelling in a direction of relative movement to a print medium, print elements having different ejection directions of liquid droplets are made to coexist and arrayed. Hereby, a liquid ejection head capable of suppressing degradation of print quality due to a white stripe/black stripe etc. could be actualized without using a high degree of microfabrication technology.

Meanwhile, where there exists shift by a half of a print element as shown in the embodiment, the effect may be obtained when there are three or more rows of the print element row.

(Sixth Embodiment)

Hereinafter, a sixth embodiment of the present invention will be described with reference to the drawings. Meanwhile, the basic configuration of the embodiment is similar to that of the first embodiment, and, therefore, only characteristic configurations will be described below.

Figure 10:
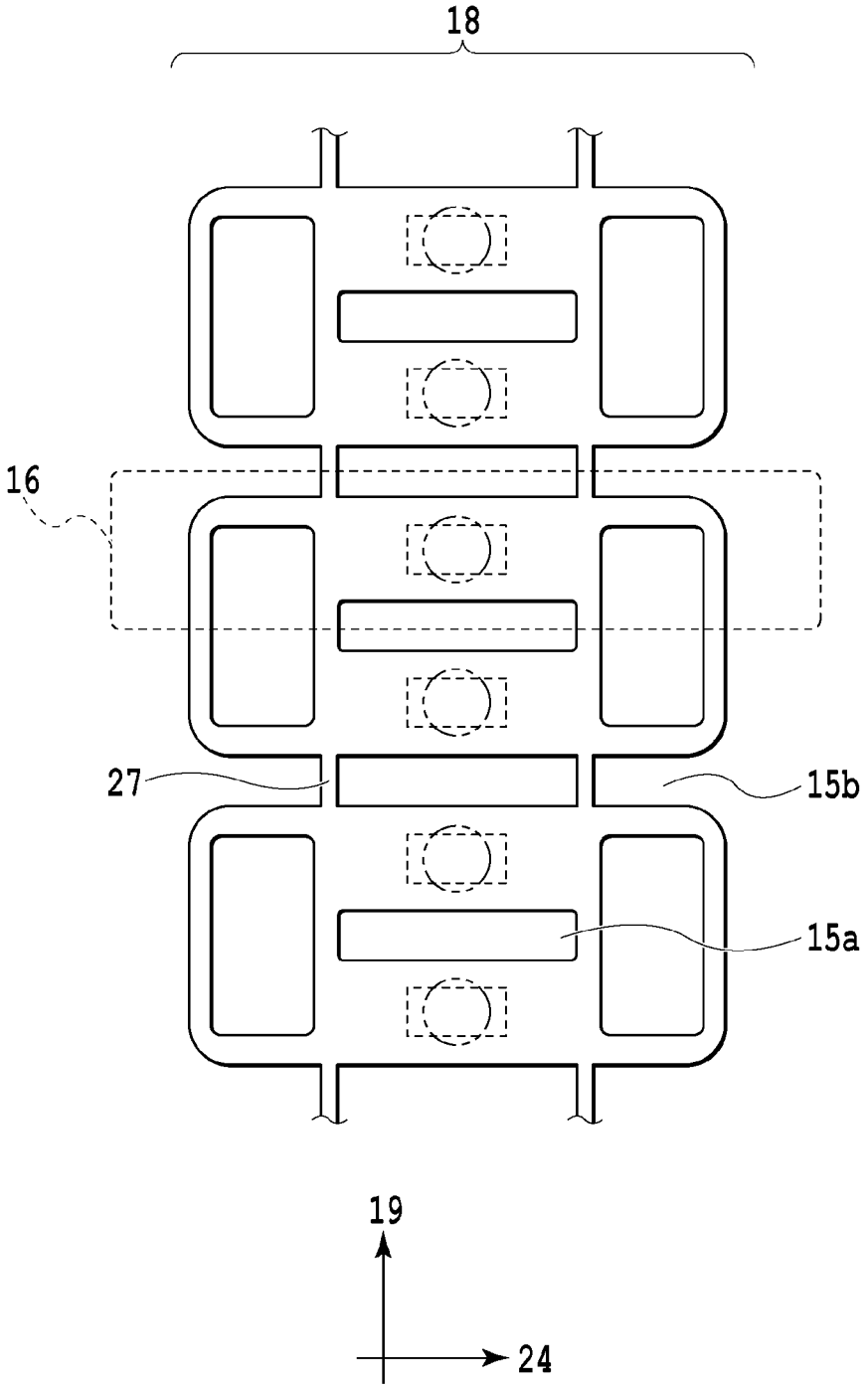
FIG. 10 is a drawing partially showing print element rows in a print element substrate.
Figure 11:
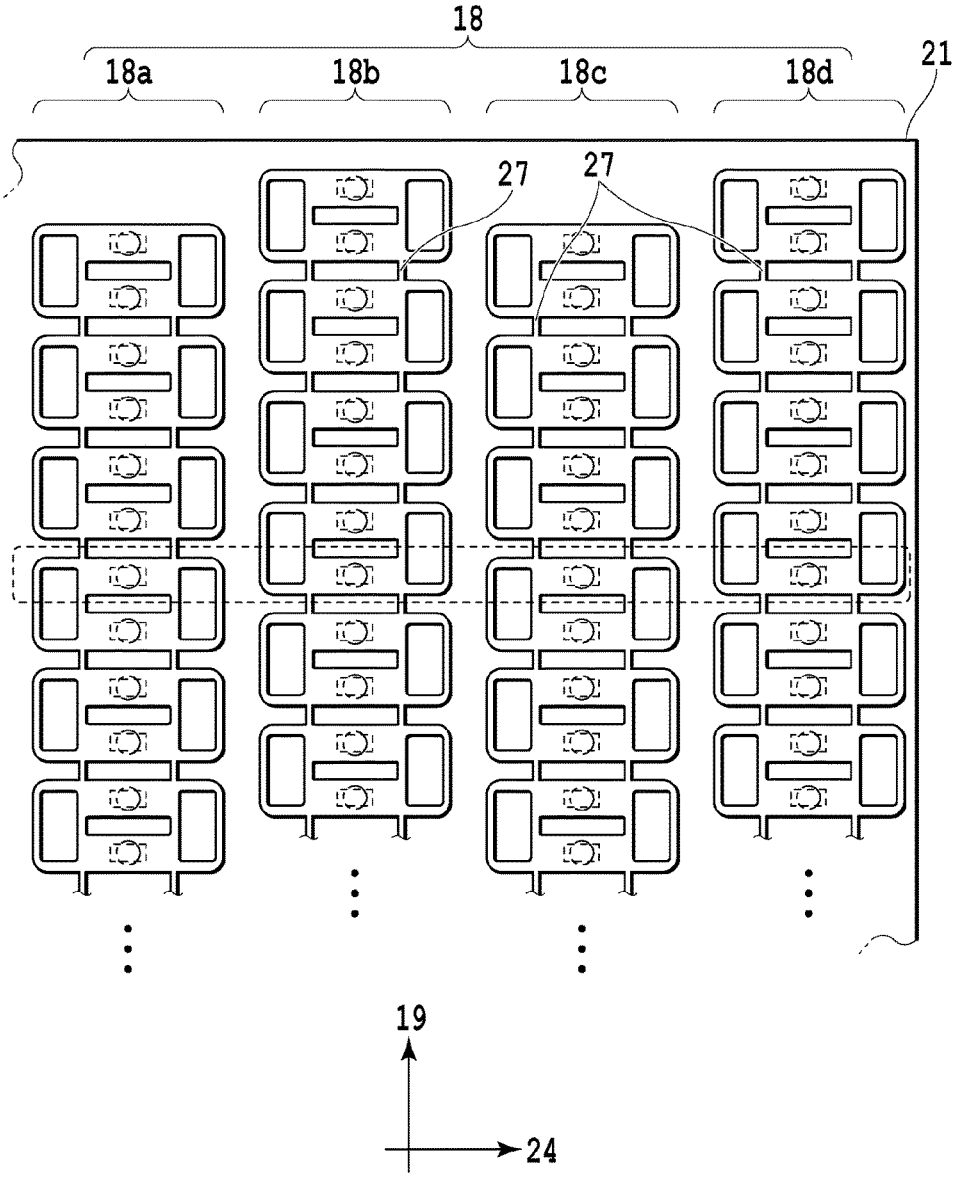
FIG. 11 is a drawing showing print element rows in a print element substrate.

FIG. 10 is a drawing partially showing print element rows in the print element substrate 21 of the embodiment, and FIG. 11 is a drawing showing print element rows in the print element substrate 21. In the embodiment, a slit 27 is formed for the long channel wall 15*b*. As a result of forming the slit 27, a liquid is communicated between print elements estranged by the long channel wall 15*b* to slightly reduce the effect of suppressing cross talk. However, even if the supply of a liquid is stopped due to clogging of contaminants etc. in a liquid supply port, a liquid may be supplied from another print element through the slit. Further, the formation of the slit 27 reduces the volume of the channel wall, and, therefore, there is also an effect of reducing asymmetric deformation of an ejection port during swelling.

In this way, as a result of forming a slit for the long channel wall 15*b* to be deformed asymmetrically by swelling in a direction of relative movement to a print medium, print elements having different ejection directions of liquid droplets are made to coexist and arrayed. Hereby, a liquid ejection head capable of suppressing degradation of print quality due to a white stripe/black stripe etc. could be actualized without using a high degree of microfabrication technology.

(Seventh Embodiment)

Hereinafter, a seventh embodiment of the present invention will be described with reference to the drawings. Meanwhile, the basic configuration of the embodiment is similar to that of the first embodiment, and, therefore, only characteristic configurations will be described below.

Figure 12:
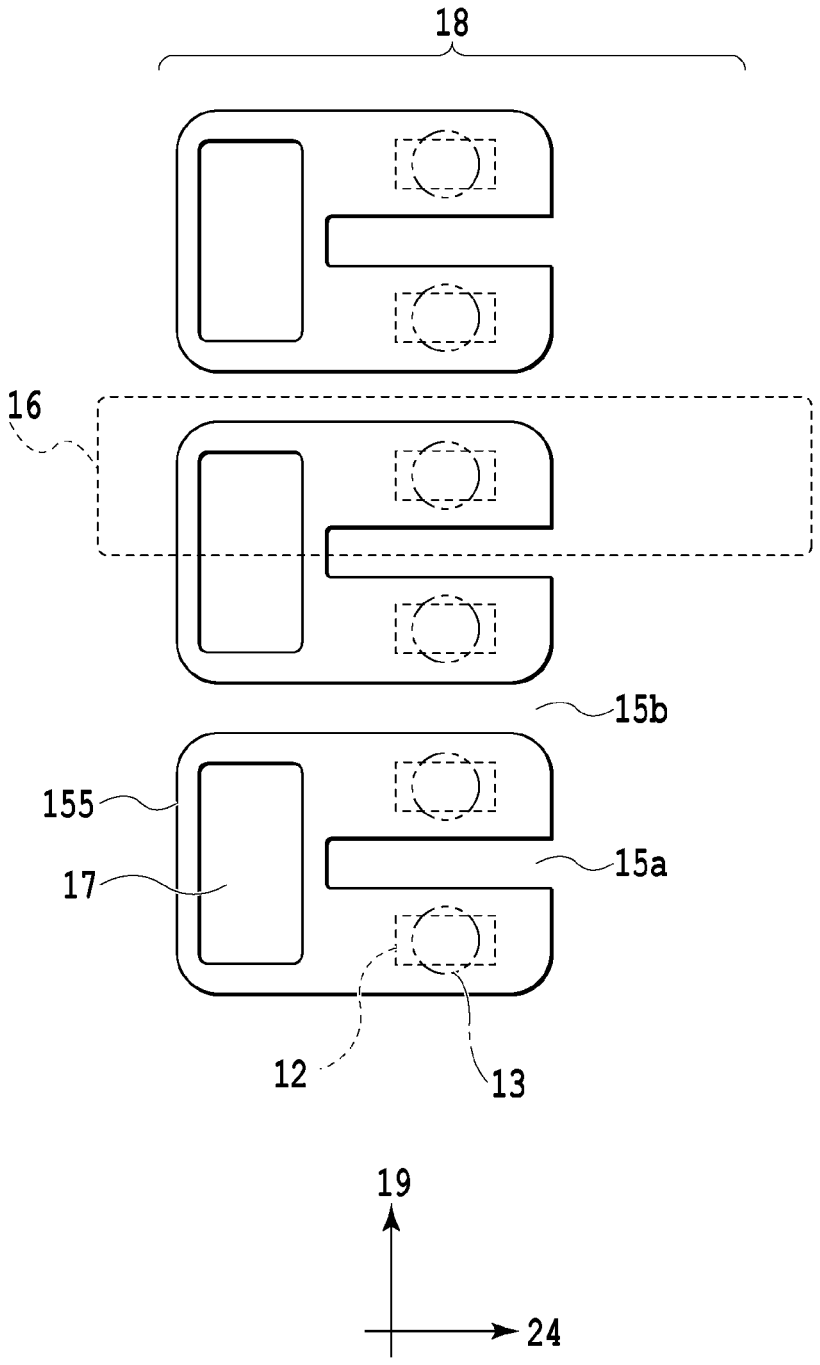
FIG. 12 is a drawing partially showing print element rows in a print element substrate.
Figure 13:
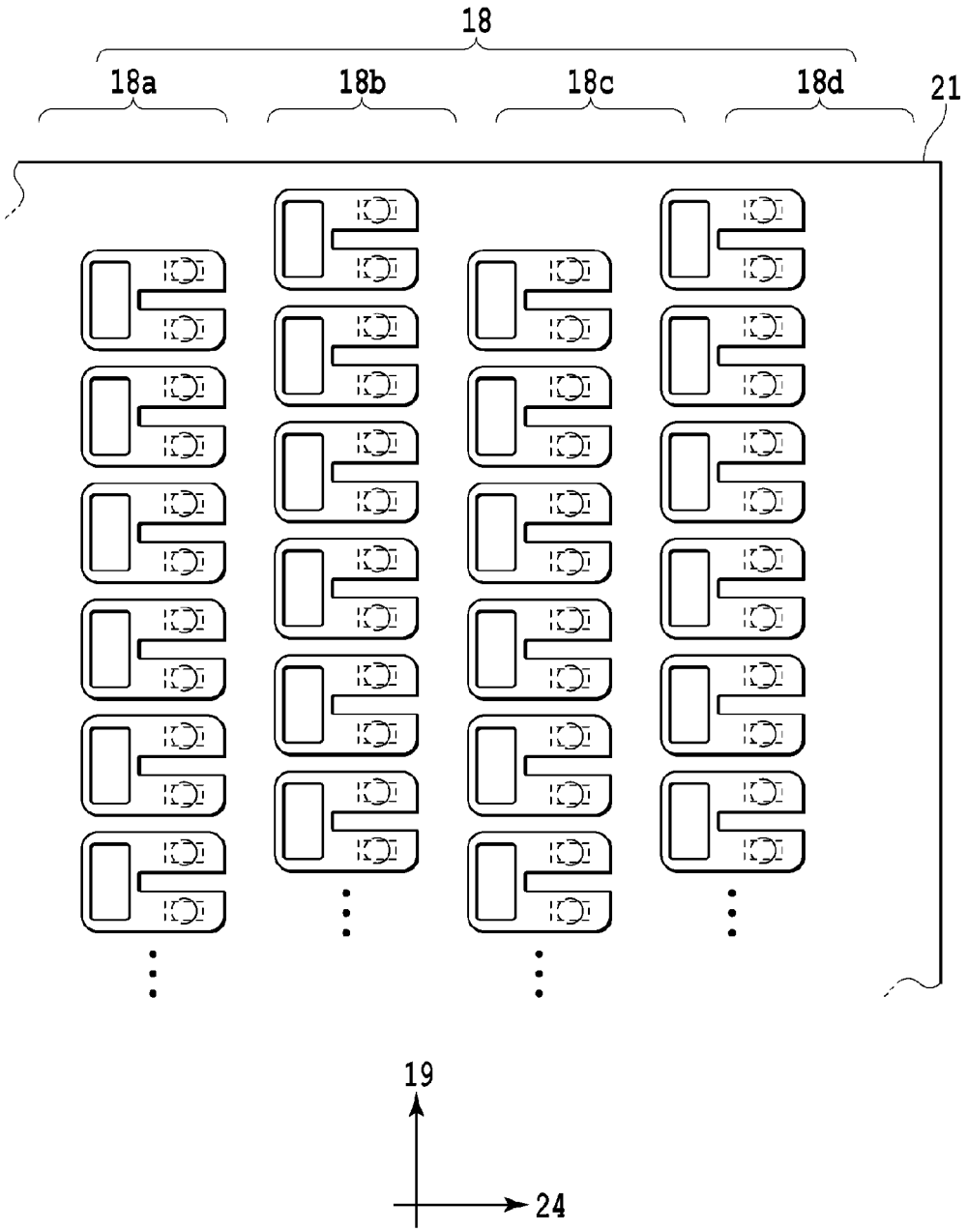
FIG. 13 is a drawing showing print element rows in a print element substrate.

FIG. 12 is a drawing partially showing print element rows in the print element substrate 21 of the embodiment, and FIG. 13 is a drawing showing print element rows in the print element substrate 21. In the embodiment, the liquid supply port 17 is provided on only a side of the print element 16. In the embodiment, the liquid supply port 17 exists only on a side, and, therefore, there is an advantage that width of a liquid ejection tip may be made thin.

In this way, as a result of arranging the print element rows 18 of the embodiment as in FIG. 13 to be deformed asymmetrically by swelling in a direction of relative movement to a print medium, print elements having different ejection directions of liquid droplets are made to coexist and arrayed. Hereby, a liquid ejection head capable of suppressing degradation of print quality due to a white stripe/black stripe etc. could be actualized without using a high degree of microfabrication technology. Hereby, a liquid ejection head capable of suppressing degradation of print quality due to a white stripe/black stripe etc. in which print elements driven at a high speed were arranged in high density could be actualized without using a high degree of microfabrication technology.

In above-described respective embodiments, the configuration, in which a liquid is supplied to the energy-generating element from supply ports provided on both sides thereof, is described, but the present invention is not limited to this. A liquid is supplied to the energy-generating element from a supply port on a side of the energy-generating element, and the liquid is ejected from the ejection port. It maybe applied to a configuration in which the liquid not having been ejected flows outside the liquid ejection head from the supply port on the other side of the energy-generating element. It may also be applied to a so-called circulating configuration in which a liquid having flown outside the liquid ejection head is supplied again to the liquid ejection head. In this case, a configuration of a liquid ejection head is given, in which a pressure chamber equipped with an energy-generating element therein is equipped, and a liquid in the pressure chamber is circulated between the inside and the outside of the pressure chamber.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-107678 filed May 30, 2016, which is hereby incorporated by reference wherein in its entirety.

What is claimed is:

1. A liquid ejection head comprising arrayed substrates provided with:

a plurality of ejection ports provided for a plate member, a plurality of energy-generating elements, each provided facing a corresponding ejection port and generating energy for use in ejecting a liquid from the corresponding ejection port, a plurality of first walls, each connected with the plate member and forming a part of a channel, through which a liquid flows, provided on a side of the plurality of energy-generating elements, and a plurality of second walls, each having a volume larger than that of the plurality of first walls and being provided on another side of the plurality of energy-generating elements, wherein a plurality of energy-generating element rows, in which at least one of the plurality of energy-generating elements is provided with a first wall in a first direction and a second wall in a second direction opposite to the first direction and at least one of the plurality of energy-generating elements in which a second wall is provided in the first direction and a first wall is provided in the second direction are arrayed, are equipped in parallel with each other at a predetermined period;

wherein the plurality of energy-generating element rows are provided, shifted in a direction in which the plurality of energy-generating elements are arrayed in a deviation by a space or less between adjacent energy-generating elements in an energy-generating element row; and wherein supply ports for supplying liquid to the plurality of energy-generating elements are provided on both sides of each of the plurality of energy-generating element rows.

2. The liquid ejection head according to claim 1, wherein the plurality of first walls and the plurality of second walls extend in a direction intersecting with the first direction, and the plurality of second walls has a length longer than that of the plurality of first walls.

3. The liquid ejection head according to claim 1, wherein the plurality of first walls and the plurality of second walls are arranged alternately in the plurality of energy-generating element rows.

4. The liquid ejection head according to claim 1, wherein two or more of the first walls are provided between the second walls in the energy-generating element row.

5. The liquid ejection head according to claim 1, wherein each first wall is provided between supply ports.

6. The liquid ejection head according to claim 1, wherein each first wall is provided adjacent to a supply port supplying a liquid to be ejected.

7. The liquid ejection head according to claim 1, wherein there are four energy-generating element rows.

8. The liquid ejection head according to claim 7, wherein a pair of adjacent energy-generating element rows among the four energy-generating element rows are shifted in an array direction of the energy-generating element row.

9. The liquid ejection head according to claim 8, wherein the energy-generating element rows adjacent to each other are provided, shifted by a space between the energy-generating elements adjacent to each other in the energy-generating element rows.

10. The liquid ejection head according to claim 7, wherein the energy-generating element rows adjacent to each other are provided, shifted corresponding to half of a space between the energy-generating elements adjacent to each other in the energy-generating element rows.

11. The liquid ejection head according to claim 1, wherein a slit is provided for each second wall, and the channels sandwiching the second wall are communicated via the slit.

12. The liquid ejection head according to claim 1, further comprising a pressure chamber equipped with an energy-generating element therein, wherein a liquid in the pressure chamber is circulated between the inside and the outside of the pressure chamber.

13. A print element substrate comprising:

a plurality of ejection ports provided for a plate member;

a plurality of energy-generating elements, each provided facing a corresponding ejection port and generating energy for use in ejecting a liquid from the corresponding ejection port; and a plurality of first walls, each connected with the plate member and forming a part of a channel, through which a liquid flows, provided on a side of the plurality of energy-generating element; and a plurality of second walls, each having a volume larger than that of the plurality of first walls and being provided on another side of the plurality of energy-generating elements, wherein a plurality of energy-generating element rows, in which at least one of the plurality of energy-generating elements is provided with a first wall in a first direction and a second wall in a second direction opposite to the first direction, and at least one of the plurality of energy-generating elements is provided with a second wall in the first direction and a first wall in the second direction are arrayed at a predetermined period, are equipped, wherein the plurality of energy-generating element rows are provided, shifted in a direction in which the plurality of energy-generating elements are arrayed, in a deviation by a space or less between adjacent energy-generating elements in an energy-generating element row; and wherein supply ports for supplying liquid to the plurality of energy-generating elements are provided on both sides of each of the plurality of energy-generating element rows.

14. A liquid ejection head comprising:

first and second ejection port rows arrayed in parallel with each other in which ejection ports for ejecting a predetermined kind of liquid and flow path walls are arrayed alternately along an X-direction, wherein the flow path walls included in the first and second ejection port rows include a first flow path wall extending in a Y-direction crossing the X-direction and a second flow path wall extending in the Y-direction and longer than the first flow path wall, wherein the first flow path wall of the first ejection port row and the first flow path wall of the second ejection port row are arrayed so as to be deviated from each other with respect to the X-direction, and the second flow path wall of the first ejection port row and the second flow path wall of the second ejection port row are arranged so as to be deviated from each other with respect to the X-direction, and wherein supply ports for supplying liquid to be ejected from the ejection ports included in the first and the second ejection port rows are provided on both sides of each of the first and the second ejection port rows.

15. The liquid ejection head according to claim 14, further comprising a third ejection port row, wherein ejection ports for ejecting the predetermined kind of liquid and flow path walls are alternately arranged along the X-direction and arranged along the first ejection port row, and wherein the flow path walls included in the third ejection port row include a third flow path wall extending in the Y-direction and a fourth flow path wall longer than the third flow path wall, in the Y-direction, and the first flow path wall of the first ejection port row and the third flow path wall of the third ejection port row are arranged to overlap each other.

16. The liquid ejection head according to claim 15, wherein in the Y-direction, the second flow path wall of the first ejection port row and the fourth flow path wall of the third ejection port row overlap each other.

17. The liquid ejection head according to claim 15, wherein in the Y-direction, the first ejection port row, the second ejection port row, and the third ejection port row are arranged in this order.

18. The liquid ejection head according to claim 14, wherein the second flow path wall included in the first and second ejection port rows includes a slit for dividing the flow path wall.

19. The liquid ejection head according to claim 14, wherein the supply port includes a plurality of supply ports arranged in the X-direction.

20. The liquid ejection head according to claim 14, further comprising a pressure chamber equipped with an energy-generating element therein, wherein a liquid in the pressure chamber is circulated between the inside and the outside of the pressure chamber.

* * * * *